US011534810B2

(12) United States Patent
Sano

(10) Patent No.: US 11,534,810 B2
(45) Date of Patent: Dec. 27, 2022

(54) COOLING-WATER INJECTION CONTROL DEVICE AND COOLING-WATER INJECTION CONTROL METHOD FOR ROLLING MILL

(71) Applicant: Toshiba Mitsubishi-Electric Industrial Systems Corporation, Tokyo (JP)

(72) Inventor: Mitsuhiko Sano, Tokyo (JP)

(73) Assignee: TOSHIBA MITSUBISHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 111 days.

(21) Appl. No.: 16/981,701

(22) PCT Filed: Mar. 6, 2019

(86) PCT No.: PCT/JP2019/008874
§ 371 (c)(1),
(2) Date: Sep. 17, 2020

(87) PCT Pub. No.: WO2020/179019
PCT Pub. Date: Sep. 10, 2020

(65) Prior Publication Data
US 2021/0107047 A1 Apr. 15, 2021

(51) Int. Cl.
*B21B 45/02* (2006.01)

(52) U.S. Cl.
CPC ..... *B21B 45/0233* (2013.01)

(58) Field of Classification Search
CPC ..... B21B 37/74; B21B 37/32; B21B 37/44; B21B 45/0233; B21B 2037/002
See application file for complete search history.

(56) References Cited

U.S. PATENT DOCUMENTS 6,220,067 B1 * 4/2001 Sano ..... B21B 37/74 72/8.5

FOREIGN PATENT DOCUMENTS

| | | | |
|---|---|---|---|
| CN | 101537432 | A | 9/2009 |
| JP | 11-267730 | A | 10/1999 |
| JP | 3657750 | B2 | 6/2005 |
| JP | 2007-203362 | A | 8/2007 |

(Continued)

OTHER PUBLICATIONS

Indian Office Action dated Apr. 28, 2021 in corresponding IN patent application No. 202017038615.

(Continued)

*Primary Examiner* — Teresa M Ekiert
(74) *Attorney, Agent, or Firm* — Xsensus LLP

(57) ABSTRACT

A cooling-water injection control device and a cooling-water injection control method for a rolling mill suppress influence by change in flow rate characteristics of water injection headers. The cooling-water injection control device for a rolling mill includes a water injection amount control unit. When a plurality of water injection headers are controlled to make temperature of a material to be rolled on a delivery side of a rolling mill coincident with a target value, in a case where a flow rate of any one of the plurality of water injection headers is less than a transient flow rate between a minimum flow rate and a maximum flow rate, the water injection amount control unit controls a flow rate of any one of the plurality of water injection headers based on priority.

3 Claims, 8 Drawing Sheets

(56) References Cited

FOREIGN PATENT DOCUMENTS

| | | | |
|---|---|---|---|
| JP | 2009-095852 | A | 5/2009 |
| WO | 2013/030945 | A1 | 3/2013 |

OTHER PUBLICATIONS

Chinese Office Action dated Nov. 17, 2021 in corresponding Chinese patent application No. 201980023081.8.
International Search Report and Written Opinion dated May 28, 2019 for PCT/JP2019/008874 filed on Mar. 6, 2019, 12 pages including English Translation of the International Search Report.
Japanese Office Action dated Aug. 10, 2021 in corresponding Japanese patent application No. 2020-553667.
Chinese Office Action dated Mar. 9, 2022, in corresponding Chinese Application No. 201980023081.8, 16 pp.

* cited by examiner

| HEADER NAME | FIRST WATER INJECTION HEADER | SECOND WATER INJECTION HEADER | THIRD WATER INJECTION HEADER | FOURTH WATER INJECTION HEADER |
|---|---|---|---|---|
| MAXIMUM FLOW RATE | 80% | 90% | 95% | 100% |
| TRANSIENT FLOW RATE | 40% | 50% | 50% | 50% |
| MINIMUM FLOW RATE | 20% | 30% | 30% | 30% |

COOLING-WATER INJECTION CONTROL DEVICE AND COOLING-WATER INJECTION CONTROL METHOD FOR ROLLING MILL

CROSS-REFERENCE TO RELATED APPLICATION

The present application is based on PCT filing PCT/JP2019/008874, filed Mar. 6, 2019, the entire contents of which are incorporated herein by reference.

FIELD

The present invention relates to a cooling-water injection control device and a cooling-water injection control method for a rolling mill.

BACKGROUND

PTL 1 discloses a cooling-water injection control method for a rolling mill. According to the cooling-water injection control method, temperature of a material to be rolled on a delivery side of a rolling mill can be made coincident with a target value by changing flow rates of cooling water of a plurality of water injection headers.

CITATION LIST

Patent Literature

[PTL 1] JP 3657750 B

SUMMARY

Technical Problem

Each of the water injection headers generally includes a large number of nozzles arranged in a width direction of the material to be rolled. Therefore, the cooling water can be sprayed to uniformly and efficiently cool the material to be rolled.

In a case where a water injection amount of any of the water injection headers is small, however, the cooling water may not be uniformly distributed to the nozzles, and the water injection amount in the width direction of the material to be rolled may become nonuniform. Further, if a water amount distributed to any of the nozzles is excessively small, it is difficult to maintain a normal spray state. As a result, the water amount may be varied, and a flow may not become a laminar flow and may be interrupted or disturbed.

When these phenomena occur, a cooling capacity by the cooling water is changed to vary material temperature, which may cause non-conformance such as deterioration of surface quality, change in material quality, and rolling unstableness of the material to be rolled.

A lower limit flow rate at which such unstable phenomena caused by a small flow rate occur is about 10% to about 30% of a rated flow rate of each of the water injection headers, depending on a mechanical design of a water injection device.

To avoid the above-described non-conformance caused by unstable phenomena occurred on the water injection header that is small in the water injection amount, there is a method in which a flow rate regulation valve or an on-off valve of the header having the water injection amount less than or equal to a preset threshold (hereinafter, referred to as minimum flow rate) is closed, and the flow rate of such a header is forcibly made zero.

For example, in a case where the minimum flow rate is 30%, the water injection header is operated such that the water injection amount normally becomes 30% or more and 100% or less, or 0% (non-water injection) without using a range from more than 0% to less than 30%. In this method, the unstable phenomena at the small flow rate do not occur, but the water injection amount becomes 0% or 30% at the flow rate less than or equal to the minimum flow rate (less than 30% in example described above). Accordingly, the flow rate is not finely adjustable. As a result, temperature of the material to be rolled on the delivery side of the rolling mill is largely varied.

In a case where the plurality of water injection headers are operated at a time, such unstable phenomena at the small flow rate easily occur. This is because, in a case where the necessary water injection amount is small due to, for example, passing speed limitation, when the water injection amount is distributed to the plurality of water injection headers, the water injection amount per one water injection header is extremely small. For example, in a case where the number of water injection headers is 4 in the example in which the minimum flow rate is 30%, the maximum total water injection amount of the four water injection headers is 400% of the rated flow rate of a single water injection header. In contrast, in a case where the water injection amount of each of the water injection headers is up to 30%, namely, in a case where the total water injection amount of the four water injection headers is less than or equal to 120% of the rated flow rate of a single water injection header, the unstable phenomena may occur.

On the other hand, in a case where the water injection headers are operated one by one based on a priority order, only one header is operated at a time. Therefore, the unstable phenomena at the small flow rate hardly occur as compared with the case where the plurality of water injection headers are operated at a time. For example, in the example in which the minimum flow rate is 30%, the unstable phenomena may occur only in a case where the water injection amount of a first water injection header is up to 30%, namely, only in a case where the total water injection amount of the four water injection headers is less than or equal to 30% of the rated flow rate of a single water injection header.

In the case where the water injection headers are operated one by one based on the priority order, however, influence by change in characteristics of the individual water injection headers is large. The characteristics such as the maximum flow rate and a response time to a water injection instruction of each of the water injection headers of the water injection device are varied day by day due to mechanical deterioration and the like. Although periodic maintenance is performed about once every few weeks, the characteristics are inevitably varied at a certain degree. In the case where the water injection headers are operated one by one based on the priority order, change in the characteristics of the water injection header to be operated easily causes variation of the temperature of the material to be rolled on the delivery side of the rolling mill.

In contrast, in the case where the plurality of water injection headers are operated at a time, switching timing deviation by variation in the response characteristics of the individual water injection headers and influence by variation in the flow rate characteristics of the individual water injection headers are averaged among the plurality of water injection header, as compared with the case where the water injection headers are operated one by one based on the priority order. This makes it possible to suppress the influence.

As described above, in the case where the water injection headers are operated one by one based on the priority order, influence by the header switching timing deviation in acceleration and influence by variation in the flow rate characteristics of the water injection headers at a steady speed are large. In the case where the plurality of water injection headers are operated at a time, the unstable phenomena at the small flow rate easily occur at a head end tensionless part or other parts.

For example, in the cooling water injection control method disclosed in PTL 1, the plurality of water injection headers are controlled one by one based on the priority order. More specifically, the water injection header having high priority is operated. When the flow rate of the water injection header reaches the maximum flow rate or the minimum flow rate, the water injection header having next high priority is operated. Accordingly, influence by change in the flow rate characteristics of the water injection headers such as the maximum flow rate, the response time to the injection instruction, and the like of each of the water injection headers is large.

The present invention is made to solve the above-described issues. An object of the present invention is to provide a cooling-water injection control device and a cooling-water injection control method for a rolling mill that make it possible to suppress influence by change in flow rate characteristics of water injection headers.

Solution to Problem

A cooling-water injection control device for a rolling mill according to the present invention includes a water injection amount control unit. When a plurality of water injection headers are controlled to make temperature of a material to be rolled on a delivery side of a rolling mill coincident with a target value, in a case where a flow rate of any one of the plurality of water injection headers is less than a transient flow rate between a minimum flow rate and a maximum flow rate, the water injection amount control unit controls a flow rate of any one of the plurality of water injection headers based on priority to establish a state where each of the plurality of water injection headers does not inject water or injects water at a flow rate between the minimum flow rate and the transient flow rate, and in a case where the flow rate of each of the plurality of water injection headers is greater than or equal to the transient flow rate, the water injection amount control unit controls the flow rates of the plurality of water injection headers at a time to establish a state where each of the plurality of water injection headers injects water at a flow rate between the transient flow rate and the maximum flow rate.

A cooling-water injection control method for a rolling mill according to the present invention includes controlling a water injection amount. When a plurality of water injection headers are controlled to make temperature of a material to be rolled on a delivery side of a rolling mill coincident with a target value, in a case where a flow rate of any one of the plurality of water injection headers is less than a transient flow rate between a minimum flow rate and a maximum flow rate, a flow rate of any one of the plurality of water injection headers is controlled based on priority to establish a state where each of the plurality of water injection headers does not inject water or injects water at a flow rate between the minimum flow rate and the transient flow rate, and in a case where the flow rate of each of the plurality of water injection headers is greater than or equal to the transient flow rate, the flow rates of the plurality of water injection headers are controlled at a time to establish a state where each of the plurality of water injection headers injects water at a flow rate between the transient flow rate and the maximum flow rate.

Advantageous Effects of Invention

According to the present invention, in the case where the flow rate of any one of the plurality of water injection headers is less than the transient flow rate between the minimum flow rate and the maximum flow rate, the flow rate of any one of the plurality of water injection headers is controlled based on the priority to establish the state where each of the plurality of water injection headers does not inject water or injects water at the flow rate between the minimum flow rate and the transient flow rate. Further, in the case where the flow rate of each of the plurality of water injection headers is greater than or equal to the transient flow rate, the flow rates of the plurality of headers are controlled at a time to establish the state where each of the plurality of water injection headers injects water at the flow rate between the transient flow rate and the maximum flow rate. This makes it possible to suppress influence by change in the flow rate characteristics of the water injection headers.

DESCRIPTION OF EMBODIMENTS

Figure 1:
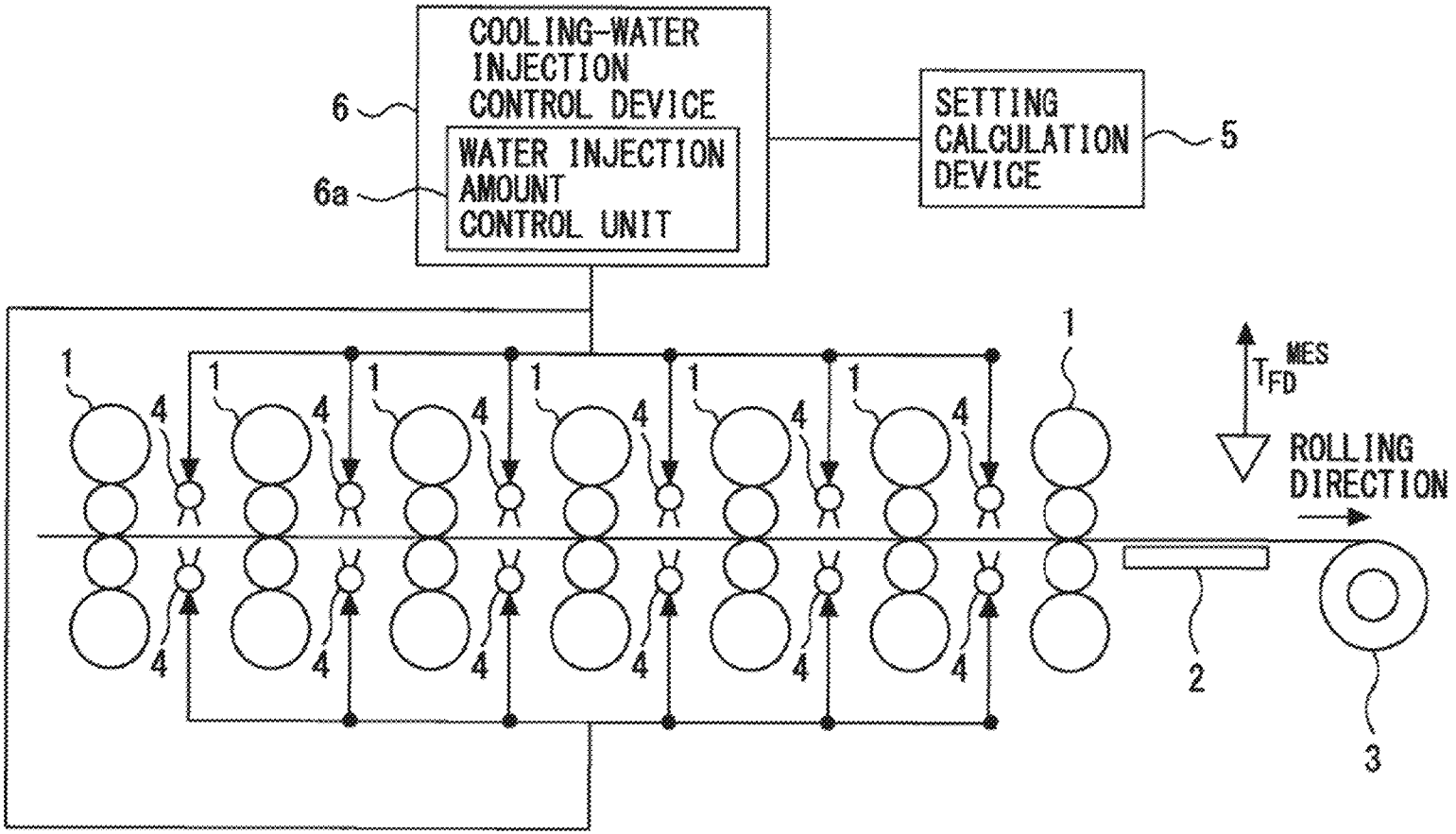
FIG. 1 is a configuration diagram of a main part of a rolling line to which a cooling-water injection control device for a rolling mill according to Embodiment 1 is applied.

Some embodiments of the present invention are described with reference to accompanying drawings. Note that, in the drawings, the same or equivalent parts are denoted by the same reference numerals. Repetitive descriptions of the parts are appropriately simplified or omitted.

Embodiment 1

FIG. 1 is a configuration diagram of a main part of a rolling line to which a cooling-water injection control device for a rolling mill according to Embodiment 1 is applied.

A rolling mill includes at least one rolling mill 1. For example, the rolling mill 1 is a finishing mill of hot strip rolling. The rolling mill 1 includes seven rolling mills 1.

A heating furnace and a roughing mill are provided on an upstream side of the finishing mill. In the heating furnace, a material to be rolled having a thickness of about 200 mm to about 250 mm is heated to about 1200° C. Thereafter, the material to be rolled is rolled by the roughing mill until the thickness becomes about 20 mm to about 50 mm. Thereafter, the material to be rolled is conveyed to the finishing mill by an electric conveyance table.

A cooling table 2 and a coiler 3 are provided on a downstream side of the finishing mill. The cooling table 2 cools the rolled material to be rolled by a large number of cooling water nozzles. The coiler 3 rolls up the cooled material to be rolled in a coil shape.

In the finishing mill, each of the plurality of rolling mills 1 includes a screw-down device and a motor. The screw-down device is provided to hydraulically or electrically change a roll gap of the corresponding rolling mill 1. The motor is provided to rotate rolls of the corresponding rolling mill 1.

A position of the material to be rolled is tracked based on a hot-piece detector installed at a key point of the rolling line and a speed result value of the conveyance table.

Each of a plurality of cooling-water injection devices 4 is provided between the rolling mills 1 adjacent to each other. The cooling-water injection devices 4 may be provided on an upstream side or a downstream side of the rolling mills 1. Each of the plurality of cooling-water injection devices 4 is provided to spray cooling water. For example, four sets of the cooling-water injection devices 4 on a front stage side are included in a group to be subjected to feedforward control. For example, two sets of the cooling-water injection devices 4 on a rear stage side are included in a group to be subject to feedback control.

A setting calculation device 5 calculates a thickness of the material to be rolled on a delivery side of each of the plurality of rolling mills 1 and a set value of a roll gap of each of the plurality of rolling mills 1 so as to manufacture a product with a desired thickness when the material to be rolled reaches a preset position on the upstream side of the finishing mill. A constant position control function operates the screw-down device based on a result of the calculation by the setting calculation device 5.

The setting calculation device 5 determines a head end set value of a cooling water flow rate (value of flow rate when head end of material to be rolled reaches each of rolling mills 1). The setting calculation device 5 determines a head end set value of a roll rotation speed of each of the plurality of rolling mills 1 (value of speed when head end of material to be rolled reaches each of rolling mills 1). When determining these head end set values, the setting calculation device 5 considers upper and lower limits by the cooling water flow rate, mechanical limitation of the roll rotation speed, and limitation of the roll rotation speed in the operation (limitation to avoid deterioration of surface quality due to mill vibration and generation of oxide scale on material to be rolled).

The setting calculation device 5 determines a rotation speed of the motor of the final rolling mill 1 by referring to an internal numerical table. The setting calculation device 5 calculates the rotation speed of the motor of each of the plurality of rolling mills 1 such that a volume speed of the material to be rolled on the delivery side of each of the other rolling mills 1 becomes constant in order to cause the material to be rolled to stably pass through the rolling mills 1. A constant speed control function operates the motors based on a result of the calculation by the setting calculation device 5.

In rolling, a tension control device adjusts the rotation speed of the motor of each of the rolling mills 1 so as to optimize tension acting on the material to be rolled.

A cooling-water injection control device 6 includes a water injection amount control unit 6*a*. The water injection amount control unit 6*a* controls the plurality of cooling-water injection devices 4 based on the result of the calculation by the setting calculation device 5.

Next, a method of controlling the plurality of cooling-water injection devices 4 is described with reference to FIG. 2.

Figure 2:
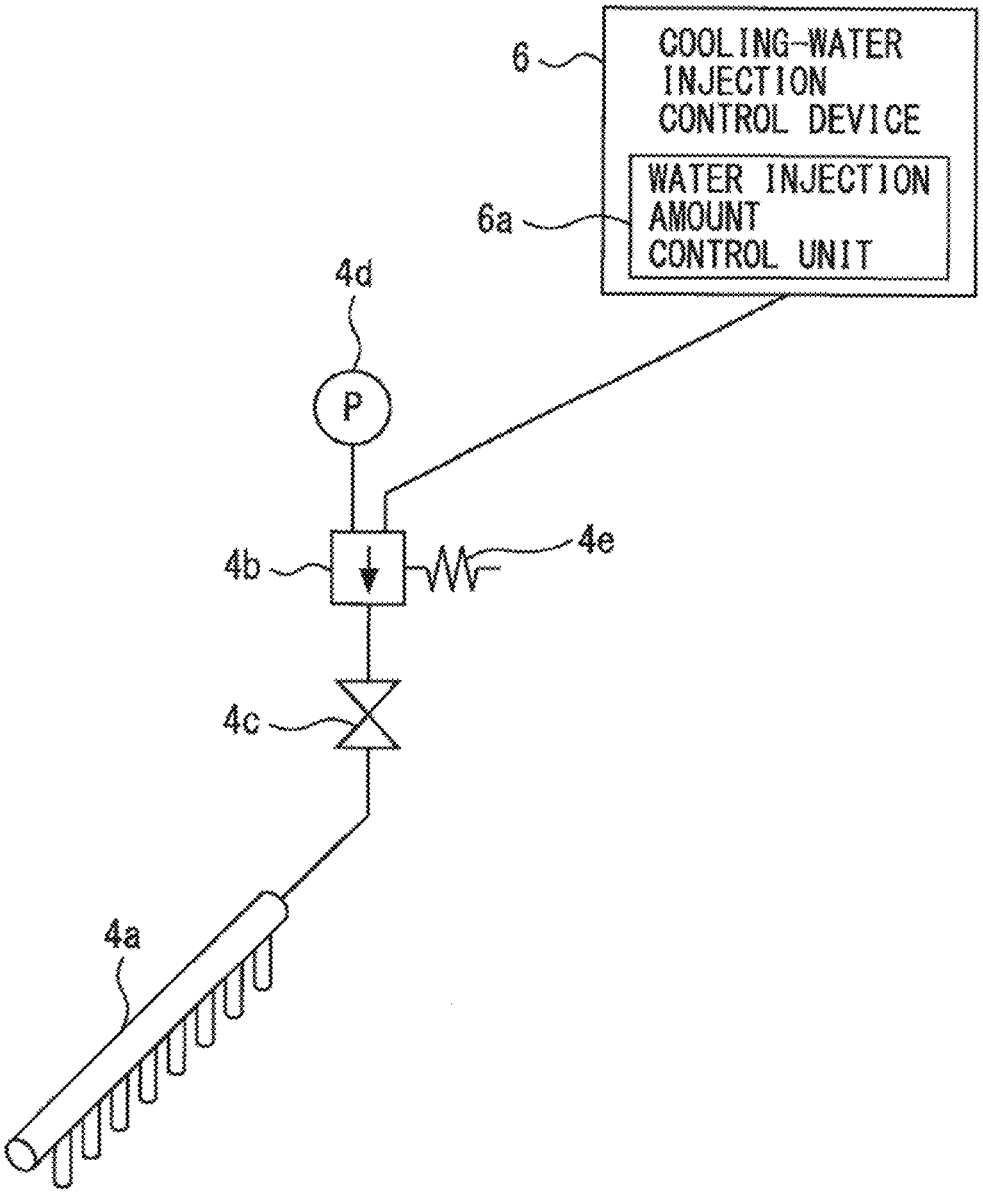
FIG. 2 is a configuration diagram of a cooling-water injection device to which the cooling-water injection control device for a rolling mill according to Embodiment 1 is applied.

FIG. 2 is a configuration diagram of a cooling-water injection device to which the cooling-water injection control device for a rolling mill according to Embodiment 1 is applied.

As illustrated in FIG. 2, each of the cooling-water injection devices 4 includes a water injection header 4*a*, a flow rate regulation valve 4*b*, an on-off valve 4*c*, a pump 4*d*, and an accumulator 4*e*.

Each of the water injection headers 4*a* is provided between the rolling mills 1 adjacent to each other (not illustrated in FIG. 2). Each of the water injection headers 4*a* includes a plurality of nozzles. The plurality of nozzles are arranged in a width direction of the material to be rolled. The plurality of nozzles are provided to spray the cooling water in order to uniformly and efficiently cool the material to be rolled. Each of the flow rate regulation valves 4*b* is provided to change the water injection flow rate of the corresponding water injection header 4*a*. Each of the on-off valves 4*c* is provided to completely block the cooling water in a case where the corresponding water injection header 4*a* is not used. Each of the pumps 4*d* is provided to supply the cooling water to the corresponding water injection header 4*a*. Each of the accumulators 4*e* is provided to suppress variation of pressure of the cooling water when the flow rate of the cooling water is abruptly changed. Each of the accumulators 4*e* is filled with, for example, nitrogen gas.

The cooling-water injection control device 6 changes the flow rate of the cooling water in units of the plurality of water injection headers 4*a*. More specifically, the water injection amount control unit 6*a* changes the flow rate of the cooling water by electrically changing an opening degree of each of the plurality of flow rate regulation valves 4*b*. For example, in the group to be subjected to the feedforward control, finishing temperature of the material to be rolled is controlled in the following manner. At this time, a broken water injection header 4*a* is excluded from the control objects.

The setting calculation device 5 calculates the flow rate of the cooling water by repetitive calculation such that an FDT predicted value as a predicted value of the temperature of the material to be rolled on a delivery side of a rolling mill array is coincident with a target value. At this time, the setting calculation device 5 uses a temperature model that is a mathematical model accurately simulating temperature change while the material to be rolled passes through the rolling mills 1. In the temperature model, the following factors (a) to (e) are considered. The setting calculation device 5 calculates the factors (a) to (e) based on a calculation expression disclosed in, for example, U.S. Pat. No. 6,220,067 B.

(a) Processing heat generation accompanying deformation of the material to be rolled at each of the plurality of rolling mills 1

(b) Frictional heat generation due to relative slip of contact surfaces of the material to be rolled and the rolls (c) Heat transfer from the contact surfaces of the material to be rolled and the rolls (d) Heat transfer to the cooling water from the surface of the material to be rolled (e) Heat radiation to the atmosphere from the surface of the material to be rolled, and heat transfer by convection Note that, in the calculation of the temperature model, heat transfer to the cooling water is necessary as an input variable. The heat transfer is expressed as a function of the flow rate of the cooling water. Therefore, a method of repetitive calculation is used in calculation of the flow rate of the cooling water. For example, the following method is used.

Priority is set to each of the plurality of water injection headers 4*a*. For example, a smaller priority number is imparted to the water injection header 4*a* having higher priority. A transient flow rate is set to each of the plurality of water injection headers 4*a*. The transient flow rate is an optional value between the minimum flow rate and the maximum flow rate of each of the plurality of water injection headers 4*a*.

First, the setting calculation device 5 regards the flow rate of each of all of the water injection headers 4*a* in the group as zero (non-water injection). Thereafter, the setting calculation device 5 uses the temperature model to calculate the FDT predicted value. In a case where the FDT predicted value is less than or equal to the target value, the setting calculation device 5 terminates the repetitive calculation. In a case where the FDT predicted value is greater than or equal to the target value, the setting calculation device 5 selects the water injection header 4*a* having the smallest priority number.

Under a condition that the water injection amount of the selected water injection header 4*a* is changed from zero (non-water injection) to the transient flow rate, the setting calculation device 5 uses the temperature model to recalculate the FDT predicted value. In the case where the FDT predicted value is greater than or equal to the target value, the setting calculation device 5 selects the water injection header 4*a* having the next smallest priority number.

Under a condition that the water injection amount of the selected water injection header 4*a* is changed from zero (non-water injection) to the transient flow rate, the setting calculation device 5 uses the temperature model to recalculate the FDT predicted value.

The setting calculation device 5 repeats the procedure until the FDT predicted value by the temperature model becomes less than the target value. The water injection header 4*a* set with the transient flow rate is referred to as an on-fixed header. The water injection header 4*a* selected at the time when the FDT predicted value becomes less than the target value is referred to as an operation object header.

Next, the setting calculation device 5 calculates the water injection amount of the operation object header between the minimum flow rate and the transient flow rate such that the FDT predicted value becomes the closest to the target value. At this time, the FDT predicted value is continuously reduced monotonically as the water injection amount is increased. Accordingly, the setting calculation device 5 calculates the FDT predicted value by using a solving method such as a method of successive substitution, a Newton's method, and a bisection method. For example, the setting calculation device 5 calculates the FDT predicted value by using the bisection method that reliably provides a solution.

In contrast, in a case where the FDT predicted value is greater than or equal to the target value even when the water injection amount of each of all of the water injection headers 4*a* becomes the transient flow rate, the setting calculation device 5 introduces a parameter $\alpha$. The parameter $\alpha$ is a proportional division ratio of the transient flow rate and the maximum flow rate. At this time, the water injection amount of each of the plurality of water injection headers 4*a* is expressed by the following expression (1).

$$\text{Water injection amount}=(1-\alpha)\times\text{transient flow rate}+\alpha\times\text{maximum flow rate} \quad (1)$$

In a case where the parameter $\alpha$ is zero, the water injection amount becomes the transient flow rate by the expression (1). In a case where the parameter $\alpha$ is 1, the water injection amount becomes the maximum flow rate.

The setting calculation device 5 determines the parameter $\alpha$ between 0 and 1 such that the FDT predicted value becomes coincident with the target value. In a case where the parameter $\alpha$ is within a range from 0 to 1, the FDT predicted value is continuously reduced monotonically. Accordingly, the setting calculation device 5 calculates the FDT predicted value by using a solving method such as a method of successive substitution, a Newton's method, and a bisection method. For example, the setting calculation device 5 calculates the FDT predicted value by using the bisection method that reliably provides a solution. The setting calculation device 5 calculates the water injection amount of each of the plurality of water injection headers 4*a* by substituting the solution of the parameter $\alpha$ into the expression (1).

After the rolling is started, the setting calculation device 5 corrects the water injection amount of each of the plurality of water injection headers 4*a* by using various kinds of result values obtained in the rolling. The calculation at this time is performed, for example, at a preset time period (e.g., 200 millisecond period), at a preset length period (e.g., 2 m period in length of material to be rolled on delivery side of rolling mill 1), or in a case where the rolling condition such as the rolling speed is largely changed (e.g., case where speed is changed by 5% or more).

At this time, the setting calculation device 5 takes in the result values of the surface temperature of the material to be rolled on the entry side of the rolling mill array, and a roll peripheral speed, the roll gap, roll force, and the like of each of the plurality of rolling mills 1. The setting calculation device 5 calculates, based on the taken-in result values, a result value of average temperature of the material to be rolled on the entry side of the rolling mill array, and a speed result value, a thickness result value, a deformation resistance result value, and the like of the material to be rolled on the delivery side of each of the plurality of rolling mills 1. The setting calculation device 5 uses the temperature model based on these calculation results, to calculate the FDT predicted value. The setting calculation device 5 calculates the water injection amount of each of the plurality of water injection headers 4*a* such that the FDT predicted value becomes coincident with the target value. At this time, the setting calculation device 5 calculates the water injection amount of each of the plurality of water injection headers 4*a* by a method similar to the method for the head end set value.

In the cooling-water injection control device 6, the water injection amount control unit 6*a* controls the plurality of cooling-water injection devices 4 based on the calculation results of the setting calculation device 5. As a result, in a case where the flow rate of any one of the plurality of water injection headers 4*a* is less than the transient flow rate between the minimum flow rate and the maximum flow rate, the water injection amount control unit 6*a* controls the flow rate of any one of the plurality of water injection headers 4*a* based on the priority to establish a state where each of the plurality of water injection headers 4*a* does not inject water or injects water at the flow rate between the minimum flow rate and the transient flow rate. In a case where the flow rate of each of the plurality of water injection headers 4*a* is greater than or equal to the transient flow rate, the water injection amount control unit 6*a* controls the flow rates of the plurality of headers at a time to establish a state where each of the plurality of water injection headers 4*a* injects water at the flow rate between the transient flow rate and the maximum flow rate.

Next, necessity of the control of the water injection amounts by the cooling-water injection devices 4 is described with reference to FIG. 3 and FIG. 4.

Figure 3:
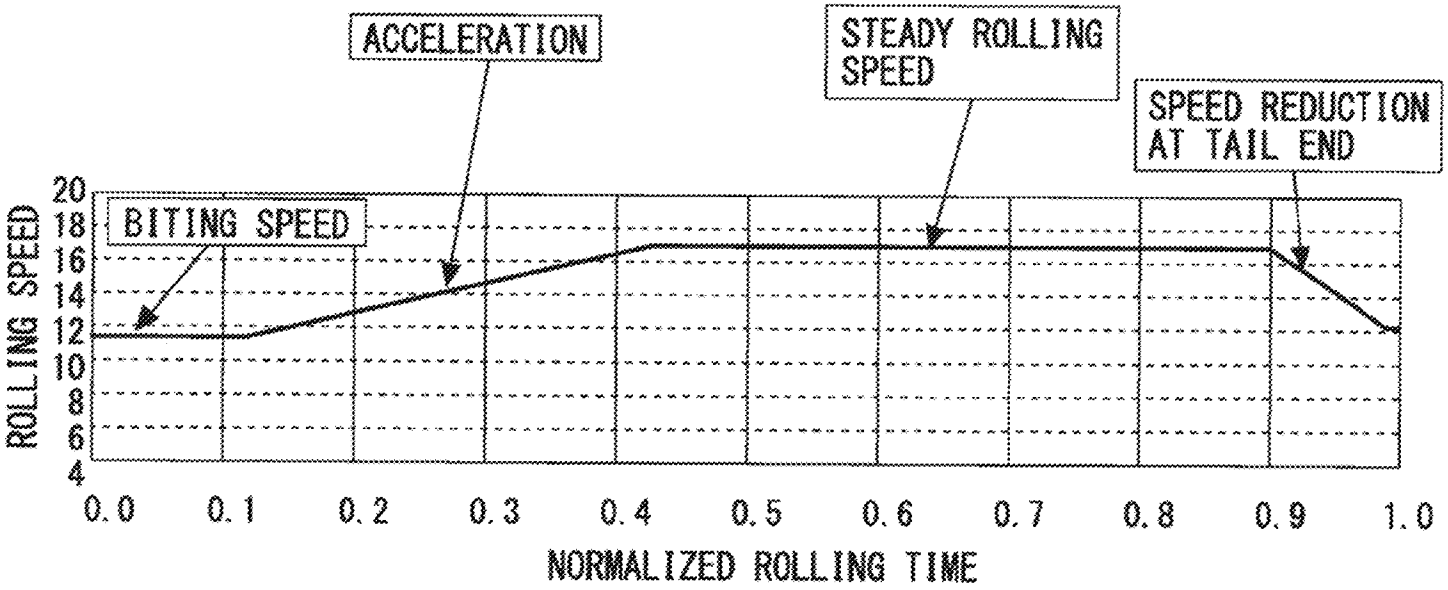
FIG. 3 is a diagram illustrating an example of a rolling speed pattern of a rolling mill to which the cooling-water injection control device for a rolling mill according to Embodiment 1 is applied.

FIG. 3 is a diagram illustrating an example of a rolling speed pattern of a rolling mill to which the cooling-water injection control device for a rolling mill according to Embodiment 1 is applied. FIG. 4 is a diagram illustrating an example of temperature of the material to be rolled on the delivery side of the rolling mill to which the cooling-water injection control device for a rolling mill according to Embodiment 1 is applied.

In FIG. 3, a lateral axis represents a normalized rolling time. A vertical axis represents the rolling speed on the delivery side of each of the rolling mills 1.

The head end of the material to be rolled advances with no tension while the head end of the material to be rolled leaves the final rolling mill 1 and reaches the coiler 3. At this time, trouble such as floating (fly up) of the material to be rolled may occur due to take-in of an airflow. Accordingly, the rolling speed at the head end of the material to be rolled is limited. The rolling speed at this time is set to a biting speed.

When the head end of the material to be rolled reaches the coiler 3, tension occurs between the final rolling mill 1 and the coiler 3. The state of the material to be rolled is stabilized by the tension. As a result, limitation of the rolling speed at the head end of the material to be rolled is eliminated. In this case, the rolling speed is increased up to a steady rolling speed that is set by the specification of a main motor, the maximum water injection amount of the cooling water, and limitation in the operation (such as occurrence of mill vibration).

When a tail end of the material to be rolled is rolled up by the coiler 3, the rolling speed is reduced.

Figure 4:
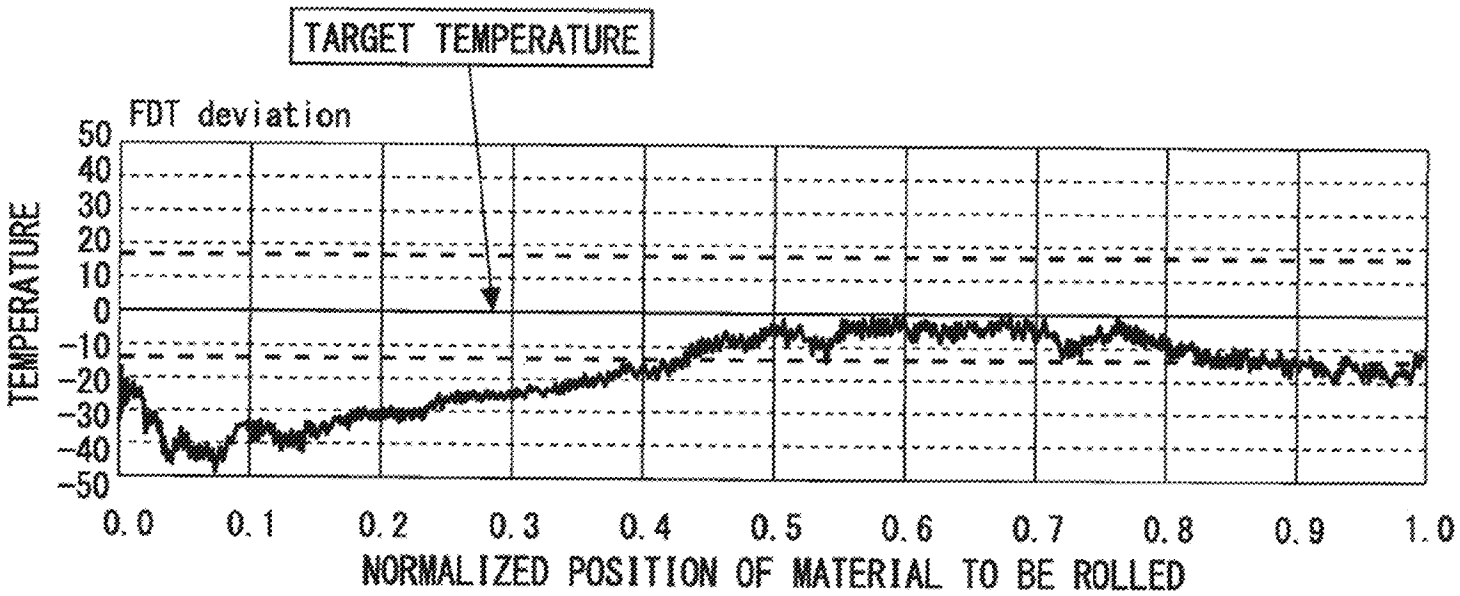
FIG. 4 is a diagram illustrating an example of temperature of a material to be rolled on a delivery side of the rolling mill to which the cooling-water injection control device for a rolling mill according to Embodiment 1 is applied.

In FIG. 4, a lateral axis represents a normalized position of the material to be rolled. A vertical axis represents the temperature of the material to be rolled.

The material to be rolled enters the rolling mills 1 from the head end. Accordingly, a waiting time of the tail end side of the material to be rolled is long on the entry side of the rolling mill 1. As a result, the entry-side temperature of the material to be rolled when the material to be rolled enters the rolling mills 1 is reduced.

To maintain the temperature of the material to be rolled on the delivery side of the rolling mill array at the target value, the cooling-water injection control device 6 changes the water injection amounts by the cooling-water injection devices 4 that are operation ends of the temperature control based on the rolling speed and change in the entry-side temperature.

According to Embodiment 1 described above, in the case where the flow rate of any one of the plurality of water injection headers 4*a* is less than the transient flow rate between the minimum flow rate and the maximum flow rate, the flow rate of any one of the plurality of water injection headers 4*a* is controlled based on the priority to establish the state where each of the plurality of water injection headers 4*a* does not inject water or injects water at the flow rate between the minimum flow rate and the transient flow rate. This makes it possible to suppress influence by change in the flow rate characteristics of the water injection headers 4*a*.

Further, in the case where the flow rate of each of the plurality of water injection headers 4*a* is greater than or equal to the transient flow rate, the flow rates of the plurality of headers are controlled at a time to establish the state where each of the plurality of water injection headers 4*a* injects water at the flow rate between the transient flow rate and the maximum flow rate. Accordingly, the switching timing deviation by variation in the response characteristics of the individual water injection headers 4*a* and influence by variation in the flow rate characteristics of the individual water injection headers 4*a* are averaged among the plurality of water injection headers 4*a*. This makes it possible to suppress influence by the change in the flow rate characteristics of the water injection headers 4*a*.

Note that a calculation load may be reduced by focusing on small change of the FDT predicted value from the preceding calculation. In this case, first, in a case where the FDT predicted value is greater than the target value with the water injection amount same as the water injection amount in the preceding calculation as a base point, the water injection amount is increased by a procedure similar to the procedure in the case of the head end setting. More specifically, the transient flow rate of the water injection headers 4*a* are set in order from small priority number until the FDT predicted value becomes less than the target value. As for the water injection header 4*a* at the time when the FDT predicted value becomes less than the target value, the water injection amount is calculated between the minimum flow rate and the transient flow rate such that the FDT predicted value becomes the closest to the target value. In the case where the FDT predicted value is greater than the target value even when the water injection amount of each of all of the water injection headers 4*a* becomes the transient flow rate, the solution of the parameter $\alpha$ is calculated such that the FDT predicted value becomes coincident with the target value, and the water injection amount of each of all of the water injection headers 4*a* is calculated by the expression (1).

In a case where the FDT predicted value is less than the target value with the water injection amount same as the water injection amount in the preceding calculation as a base point, the water injection amount is reduced by a procedure reverse to the above-described procedure. More specifically, in a case where there is a water injection header 4*a* having the water injection amount exceeding the transient flow rate, the solution of the parameter α is calculated such that the FDT predicted value becomes coincident with the target value, and the water injection amount of each of the plurality of water injection headers 4*a* is calculated by the expression (1). In a case where the FDT predicted value is less than the target value even when the water injection amount of each of all of the water injection headers 4*a* becomes the transient flow rate, the water injection amount of each of the headers is sequentially set to zero (non-water injection) in order from the small priority number until the FDT predicted value exceeds the target value. As for the water injection header 4*a* at the time when the FDT predicted value exceeds the target value, the water injection amount is calculated between the minimum flow rate and the transient flow rate such that the FDT predicted value becomes the closest to the target value.

Further, in a case of performing the feedback control based on the measurement value (FDT result value) of a pyrometer on the delivery side of the rolling mill, an FDT deviation (=FDT result value−FDT target value) is subtracted from an FDT internal target value through a controller such as a PI controller for correction. The FDT internal target value is a value obtained by correcting an original FDT target value and is applied only to internal control. In this case, the above-described calculation is performed on the FDT internal target value.

Note that the transient flow rate and the maximum flow rate of each of the plurality of water injection headers 4*a* may be changed depending on the characteristics of the water injection headers 4*a* and circumstances in the operation. The priority numbers of the plurality of water injection headers 4*a* may be changed based on chemical components, a target dimension, a target value, and the like of the material to be rolled.

In addition, the priority numbers of the plurality of water injection headers 4*a* may be changed between a case where the water injection amount is increased and a case where the water injection amount is reduced. For example, in the case where the water injection amount is increased, the priority number of the water injection header 4*a* on the upstream side may be reduced. In the case where the water injection amount is reduced, the priority number of the header on the downstream side may be reduced.

Next, an example of the cooling-water injection control device 6 is described with reference to FIG. 5.

Figure 5:
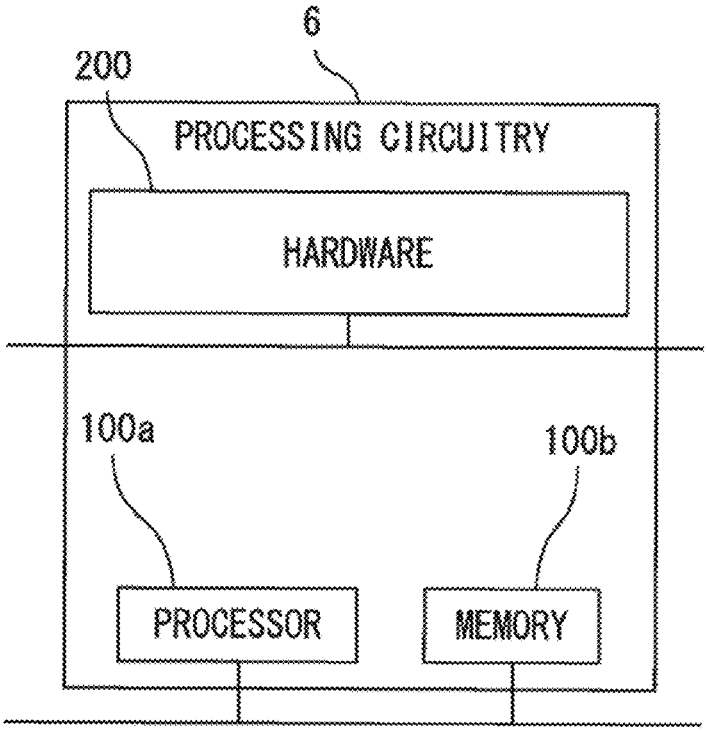
FIG. 5 is a hardware configuration diagram of the cooling-water injection control device for a rolling mill according to Embodiment 1.

FIG. 5 is a hardware configuration diagram of the cooling-water injection control device for a rolling mill according to Embodiment 1.

The functions of the cooling-water injection control device 6 can be realized by a processing circuitry. For example, the processing circuitry includes at least one processor 100*a* and at least one memory 100*b*. For example, the processing circuitry includes at least one dedicated hardware 200.

In a case where the processing circuitry includes the at least one processor 100*a* and the at least one memory 100*b*, each of the functions of the cooling-water injection control device 6 is realized by software, firmware, or a combination of the software and the firmware. At least one of the software and the firmware is described as a program. At least one of the software and the firmware is stored in the at least one memory 100*b*. The at least one processor 100*a* reads out and executes a program stored in the at least one memory 100*b*, to realize each of the functions of the cooling-water injection control device 6. The at least one processor 100*a* is also referred to as a central processing unit, a processing device, a calculation device, a microprocessor, a microcomputer, or a DSP. For example, the at least one memory 100*b* is a nonvolatile or volatile semiconductor memory such as a RAM, a ROM, a flash memory, an EPROM, and an EEPROM, a magnetic disk, a flexible disk, an optical disk, a compact disk, a minidisk, or a DVD.

In the case where the processing circuitry includes the at least one dedicated hardware 200, the processing circuitry is realized by, for example, a single circuit, a composite circuit, a programmed processor, a parallel-programmed processor, an ASIC, a FPGA, or a combination thereof. For example, the functions of the cooling-water injection control device 6 are each realized by the processing circuitry. For example, the functions of the cooling-water injection control device 6 are collectively realized by the processing circuitry.

A part of the functions of the cooling-water injection control device 6 may be realized by the dedicated hardware 200, and the other functions may be realized by the software or the firmware. For example, the function of the water injection amount control unit 6*a* may be realized by the processing circuitry as the dedicated hardware 200, and the functions other than the function of the water injection amount control unit 6*a* may be realized in such a manner that the at least one processor 100*a* reads out and executes programs stored in the at least one memory 100*b*.

As described above, the processing circuitry realizes the functions of the cooling-water injection control device 6 by the hardware 200, the software, the firmware, or a combination thereof.

Embodiment 2

Figures 6, 7:
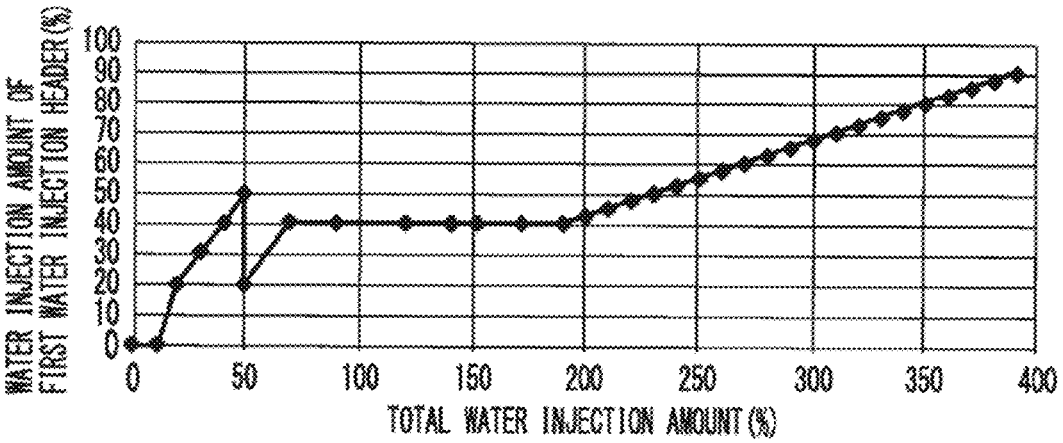
FIG. 6 is a diagram illustrating examples of parameters of a plurality of water injection headers to which a cooling-water injection control device for a rolling mill according to Embodiment 2 is applied.
FIG. 7 is a diagram illustrating a water injection amount of a first water injection header to which the cooling-water injection control device for a rolling mill according to Embodiment 2 is applied.
Figure 8:
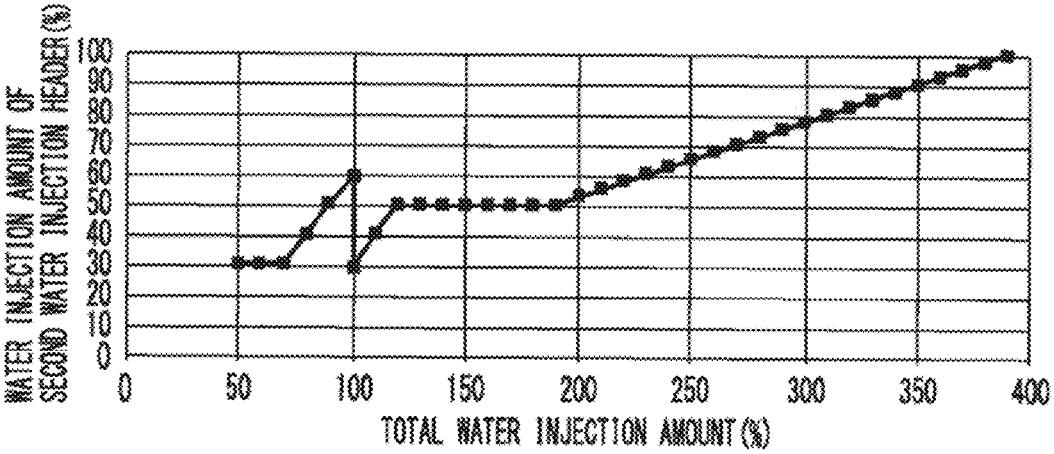
FIG. 8 is a diagram illustrating a water injection amount of a second water injection header to which the cooling-water injection control device for a rolling mill according to Embodiment 2 is applied.
Figure 9:
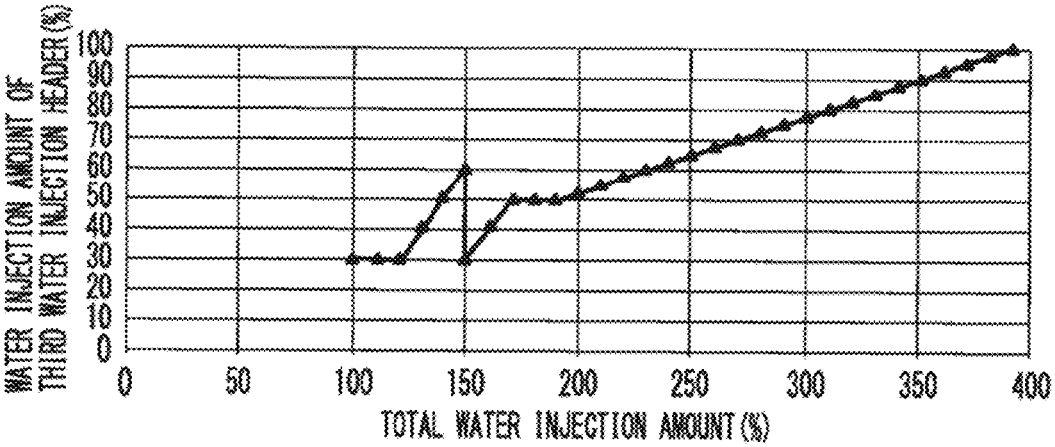
FIG. 9 is a diagram illustrating a water injection amount of a third water injection header to which the cooling-water injection control device for a rolling mill according to Embodiment 2 is applied.
Figure 10:
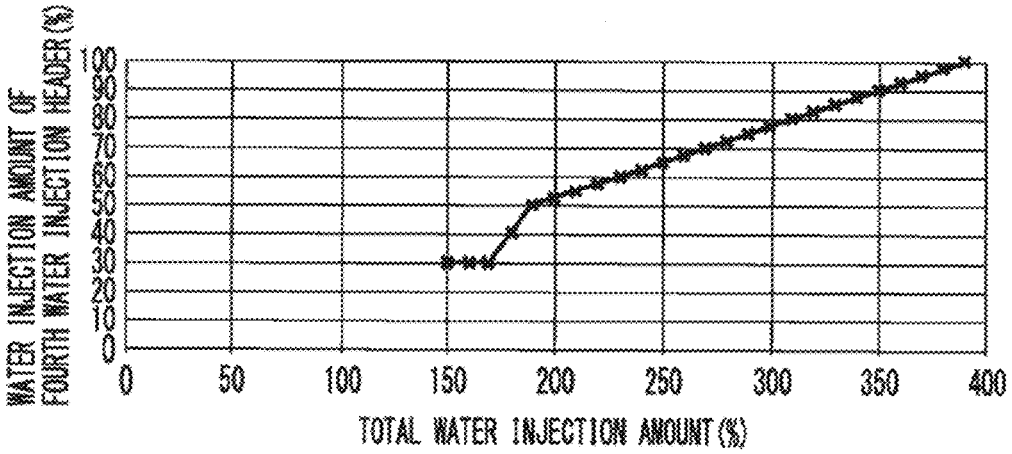
FIG. 10 is a diagram illustrating a water injection amount of a fourth water injection header to which the cooling-water injection control device for a rolling mill 1 according to Embodiment 2 is applied.

FIG. 6 is a diagram illustrating examples of parameters of the plurality of water injection headers to which a cooling-water injection control device for a rolling mill according to Embodiment 2 is applied. FIG. 7 is a diagram illustrating a water injection amount of a first water injection header to which the cooling-water injection control device for a rolling mill according to Embodiment 2 is applied. FIG. 8 is a diagram illustrating a water injection amount of a second water injection header to which the cooling-water injection control device for a rolling mill according to Embodiment 2 is applied. FIG. 9 is a diagram illustrating a water injection amount of a third water injection header to which the cooling-water injection control device for a rolling mill according to Embodiment 2 is applied. FIG. 10 is a diagram illustrating a water injection amount of a fourth water injection header to which the cooling-water injection control device for a rolling mill 1 according to Embodiment 2 is applied. Note that the parts same as or equivalent to the parts according to Embodiment 1 are denoted by the same reference numerals. Repetitive descriptions of the parts are omitted.

In the cooling-water injection control device 6 according to Embodiment 2, when the flow rate of any one of the plurality of water injection headers 4*a* is less than the transient flow rate, in a case where any one of the plurality of water injection headers 4*a* is changed from a state of not injecting water to a state of injecting water at the minimum flow rate, or in a case where any one of the plurality of water injection headers 4*a* is changed from the state of injecting water at the minimum flow rate to the state of not injecting water, the water injection amount control unit 6*a* changes the flow rate of each of the other water injection headers 4*a* among the plurality of water injection headers 4*a* to suppress change in the total water injection amount of the plurality of water injection headers.

For example, in a case where the maximum flow rate, the transient flow rate, and the minimum flow rate of each of the plurality of water injection headers 4*a* are set as illustrated in FIG. 6, the water injection amounts of the plurality of water injection headers 4*a* become amounts illustrated in FIG. 7 to FIG. 10.

For example, in a case where the total water injection amount is 50%, the second water injection header is changed from a state of not injecting water to a state of injecting water at the minimum flow rate as illustrated in FIG. 8. At this time, as illustrated in FIG. 7, the water injection amount of the first water injection header is changed from 50% to 20%. As a result, the total water injection amount is continuously changed.

For example, in a case where the total water injection amount is 100%, the third water injection header is changed from a state of not injecting water to a state of injecting water at the minimum flow rate as illustrated in FIG. 9. At this time, as illustrated in FIG. 8, the water injection amount of the second water injection header is changed from 60% to 30%. As a result, the total water injection amount is continuously changed.

For example, in a case where the total water injection amount is 150%, the fourth water injection header is changed from a state of not injecting water to a state of injecting water at the minimum flow rate as illustrated in FIG. 10. At this time, as illustrated in FIG. 9, the water injection amount of the third water injection header is changed from 60% to 30%. As a result, the total water injection amount is continuously changed.

According to Embodiment 2 described above, in the case where any one of the plurality of water injection headers 4*a* is changed from the state of not injecting water to the state of injecting water at the minimum flow rate, or in a case where any one of the plurality of water injection headers 4*a* is changed from the state of injecting water at the minimum flow rate to the state of not injecting water, the flow rate of each of the other water injection headers 4*a* among the plurality of water injection headers 4*a* is changed to suppress change in the total water injection amount of the plurality of water injection headers. This makes it possible to smoothly change the total water injection amount of the plurality of water injection headers 4*a*. As a result, it is possible to more accurately control the temperature of the material to be rolled on the delivery side of the rolling mill array.

INDUSTRIAL APPLICABILITY

As described above, the cooling-water injection control device and the cooling-water injection control method for a rolling mill according to the present invention are usable in a system rolling a material to be rolled.

REFERENCE SIGNS LIST

1 Rolling mill
2 Cooling table
3 Coiler
4 Cooling-water injection device
4*a* Water injection header
4*b* Flow rate regulation valve
4*c* On-off valve
4*d* Pump
4*e* Accumulator
5 Setting calculation device
6 Cooling-water injection control device
6*a* Water injection amount control unit
100*a* Processor
100*b* Memory
200 Hardware

The invention claimed is:

1. A cooling-water injection control device for a rolling mill having a plurality of water injection headers, the cooling-water injection control device comprising:

a water injection amount control circuitry configured to receive flow rate characteristics including a minimum flow rate, a maximum flow rate, and a preset transient flow rate between the minimum flow rate and the maximum flow rate for each water injection header of the plurality of water injection headers, periodically receive a surface temperature of a material to be rolled at an entry side of the rolling mill;

periodically receive a rolling speed pattern of the rolling mill, periodically determine a flow rate for each of the plurality of water injection headers and control the plurality of water injection headers to make a predicted temperature of a material to be rolled on a delivery side of the rolling mill coincident with a target value based on a temperature model for a current surface temperature and a current rolling speed pattern, control each of the plurality of water injection headers based on a corresponding current determined flow rate, control a flow rate of any one of the plurality of water injection headers based on priority to establish a state where each of the plurality of water injection headers injects water at a flow rate between the minimum flow rate and the preset transient flow rate or does not inject water, based on the current corresponding determined flow rate of any one of the plurality of water injection headers being less than the preset transient flow rate, and control the flow rates of the plurality of water injection headers at a time to establish a state where each of the plurality of water injection headers injects water at a flow rate between the preset transient flow rate and the maximum flow rate based on the current corresponding determined flow rate of each of the plurality of water injection headers being greater than or equal to the preset transient flow rate.

2. The cooling-water injection control device for a rolling mill according to claim 1, wherein the water injection amount control circuitry is configured to change the flow rate of each of other water injection headers among the plurality of water injection headers to suppress change in a total water injection amount of the plurality of water injection headers based on any one of the plurality of water injection headers being changed from the current corresponding determined flow rate of not injecting water to injecting water at the minimum flow rate or changed from the current corresponding determined flow rate of injecting water at the minimum flow rate to not injecting water.

3. A cooling-water injection control method for a rolling mill having a plurality of water injection headers, the cooling-water injection control method comprising:

receiving flow rate characteristics including a minimum flow rate, a maximum flow rate, and a preset transient flow rate between the minimum flow rate and the maximum flow rate for each water injection header of the plurality of water injection headers, periodically receiving a surface temperature of a material to be rolled at an entry side of the rolling mill;

periodically receiving a rolling speed pattern of the rolling mill, periodically determining a flow rate for each of the plurality of water injection headers to make a predicted temperature of a material to be rolled on a delivery side of the rolling mill coincident with a target value based on a temperature model for a current surface temperature and a current rolling speed pattern, controlling each of the plurality of water injection headers based on a corresponding current determined flow rate, controlling a flow rate of any one of the plurality of water injection headers based on priority to establish a state where each of the plurality of water injection headers injects water at a flow rate between the minimum flow rate and the preset transient flow rate or does not inject water, based on the current corresponding determined flow rate of any one of the plurality of water injection headers being less than the preset transient flow rate, and controlling the flow rates of the plurality of water injection headers at a time to establish a state where each of the plurality of water injection headers injects water at a flow rate between the preset transient flow rate and the maximum flow rate based on the current corresponding determined flow rate of each of the plurality of water injection headers being greater than or equal to the preset transient flow rate.

* * * * *